US006881195B2

(12) United States Patent
Wu

(10) Patent No.: US 6,881,195 B2
(45) Date of Patent: Apr. 19, 2005

(54) MASSAGE DEVICE WITH ROLLERS DISTRIBUTED IN A PLURALITY OF ROLLER SHAFTS

(76) Inventor: Dong-Her Wu, 235 Chung-Ho Box 8-24, Taipei (TW)

( * ) Notice: Subject to any disclaimer, the term of this patent is extended or adjusted under 35 U.S.C. 154(b) by 92 days.

(21) Appl. No.: 10/213,779

(22) Filed: Aug. 8, 2002

(65) Prior Publication Data

US 2004/0030274 A1 Feb. 12, 2004

(51) Int. Cl.[7] ..... A61H 15/00

(52) U.S. Cl. ..... 601/115; 601/112; 601/99; 601/122; 601/126; 601/132

(58) Field of Search ..... 601/94, 99, 101, 601/102, 103, 115, 116, 118, 122, 124, 126–128, 132, 144, 146

(56) References Cited

U.S. PATENT DOCUMENTS 3,794,018 A * 2/1974 Repko ..... 601/115
4,011,862 A * 3/1977 Kosiak ..... 601/99
5,330,416 A * 7/1994 Masuda et al. ..... 601/99
5,618,262 A * 4/1997 Rene ..... 601/116
5,755,677 A * 5/1998 Masuda et al. ..... 601/99

FOREIGN PATENT DOCUMENTS

GB 2143436 A * 2/1985 ..... A61H/15/00

* cited by examiner

*Primary Examiner*—Danton D. DeMille
*Assistant Examiner*—Quang D. Thanh

(57) ABSTRACT

A massage device with rollers distributed in a plurality of roller shafts has a casing with a hollow opening top section, a pair of belts or chains at the left and right sides of the casing; a plurality of roller shafts inserted into the sleeves of the belts or chains. A plurality of rollers are installed on the roller shafts and the upper portion of each roller is protruded from the open section of the casing for massaging user. A plurality of transversal plates are placed in the casing. The transversal plates have driving gears and driven gears which are engaged to the belts. The gears are driven by a motor. Thereby, when the motor is actuated, the gears will be driven to rotate and thus the roller rotates. Thereby, by the massage device with rollers distributed in a plurality of roller shafts, the area of massage is larger by distributing the rollers on the open section.

2 Claims, 6 Drawing Sheets

MASSAGE DEVICE WITH ROLLERS DISTRIBUTED IN A PLURALITY OF ROLLER SHAFTS

BACKGROUND OF THE INVENTION

The present invention relates to massage devices, and particularly to a massage device with rollers distributed in a plurality of roller shafts.

In general, the massage device for massaging the backs of users necessarily has a large massage area so that the traveling ranges of the rollers are long and thus the cost is high and technology is complicated The massage device for massaging the sole of a foot has a small massaging area, but has a plurality of protruding portions or is realized by transversal rollers. Currently, the center shafts of the transversal rollers are installed around a central roller. By rotating the central rollers, the transversal roller can rotate through the portion to be massaged.

However, above said prior art structure needs a large volume and is heavy so that it becomes a large burden to a massage chair. Thereby, it is often that the structure is placed in a seat.

Moreover, the action of the transversal rollers is not uniform, in general, the action of the rollers are concentrated on several points so that the effect of massage is not preferred. Moreover, since the massaging area is confined to several points and thus the user will feel ache.

SUMMARY OF THE INVENTION

Accordingly, the primary object of the present invention is to provide a massage device with rollers distributed in a plurality of roller shafts has a casing with a hollow opening top section, a pair of belts or chains at the left and right sides of the casing; a plurality of roller shafts inserted into the sleeves of the belts or chains. A plurality of rollers are installed on the roller shafts and the upper portion of each roller is protruded from the open section of the casing so as to massage the user. A plurality of transversal plates are placed in the casing. The transversal plates have driving gears and driven gears which are engaged to the belts. The gears are driven by a motor. Thereby, when the motor is actuated, the gears will be driven to rotate and thus the roller rotates. Thereby, by the massage device with rollers distributed in a plurality of roller shafts, the area of massage is larger by distributing the rollers on the open section.

The various objects and advantages of the present invention will be more readily understood from the following detailed description when read in conjunction with the appended drawing.

BRIEF DESCRIPTION OF THE DRAWINGS

FIG. 4A is a partial enlarged schematic view of FIG. 4.

FIG. 5A is a partial enlarged view of FIG. 5.

DETAILED DESCRIPTION OF THE PREFERRED EMBODIMENTS

The feature, structure and effects of the present invention will be described hereinafter with the appended drawings.

Figure 1:
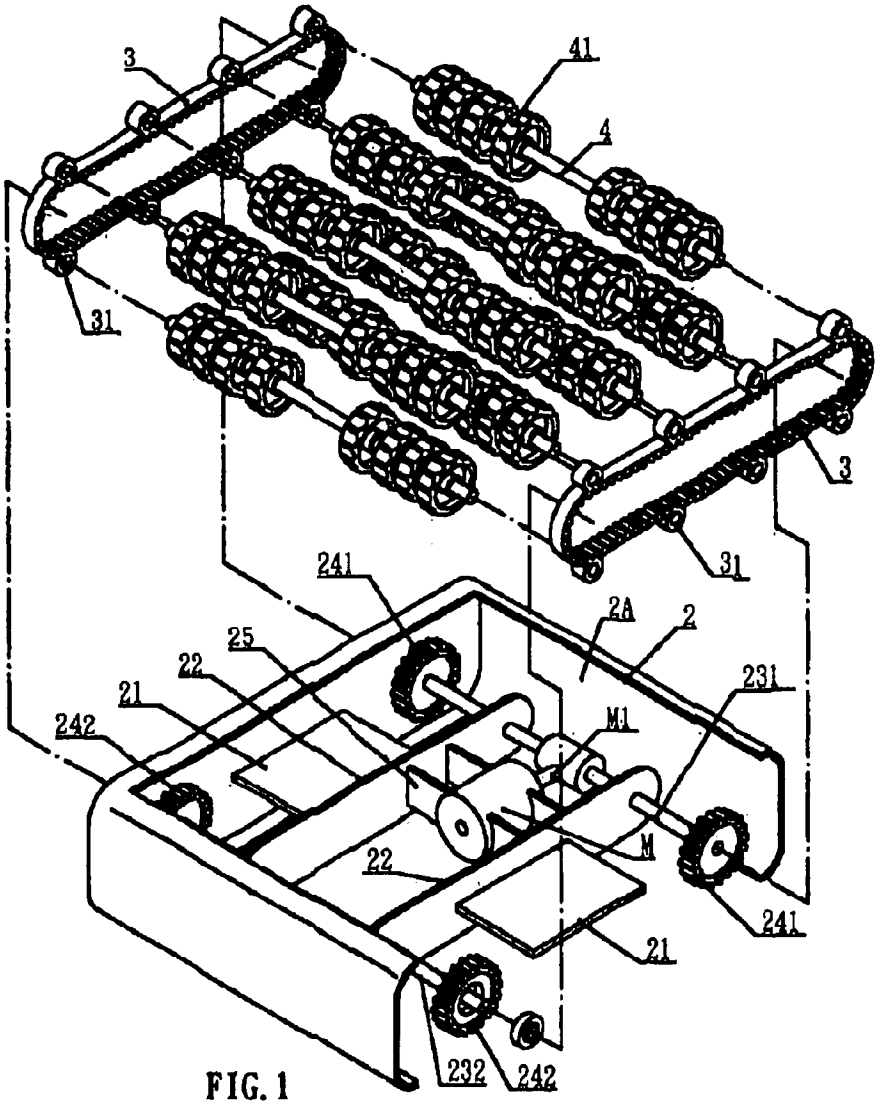
FIG. 1 is an exploded perspective view of the present invention.
Figure 2:
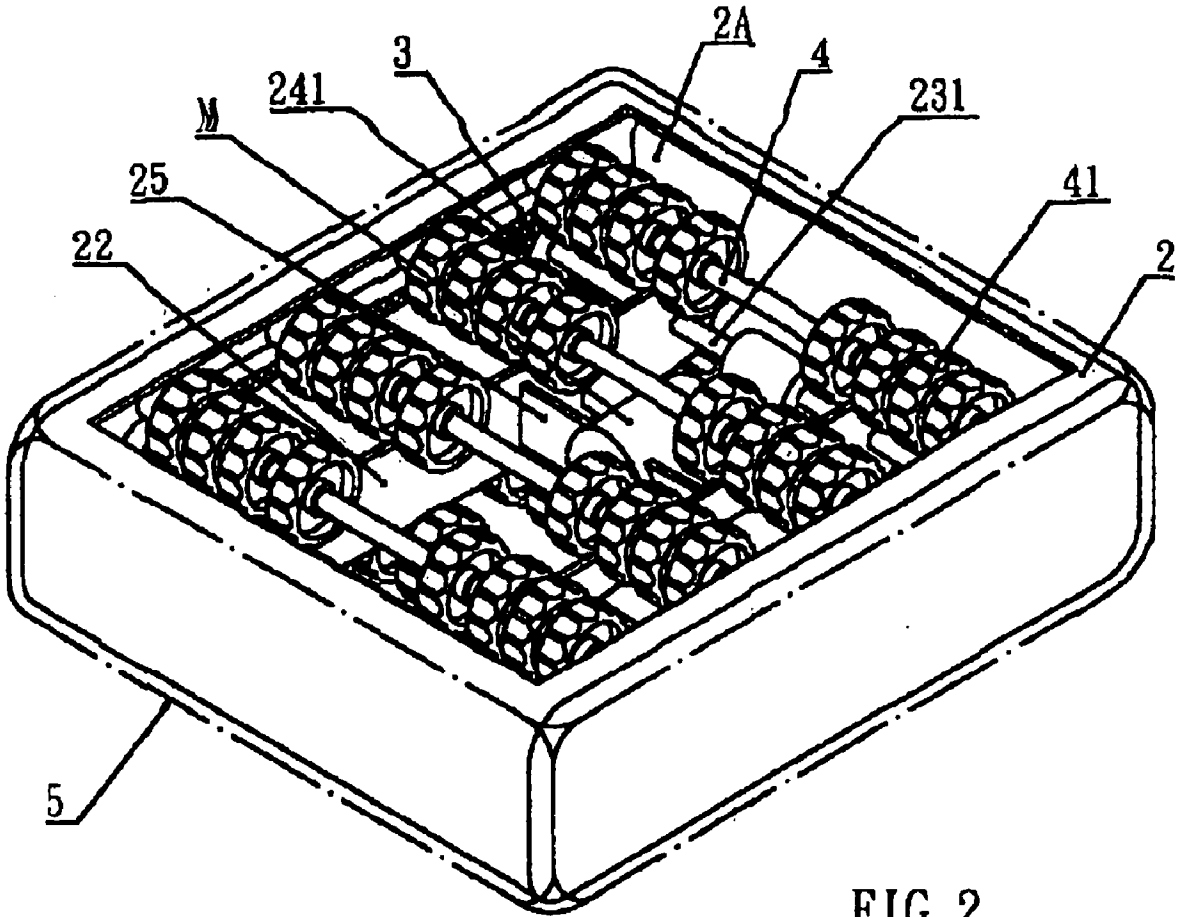
FIG. 2 is a schematic view showing the perspective view of the present invention.
Figure 3:
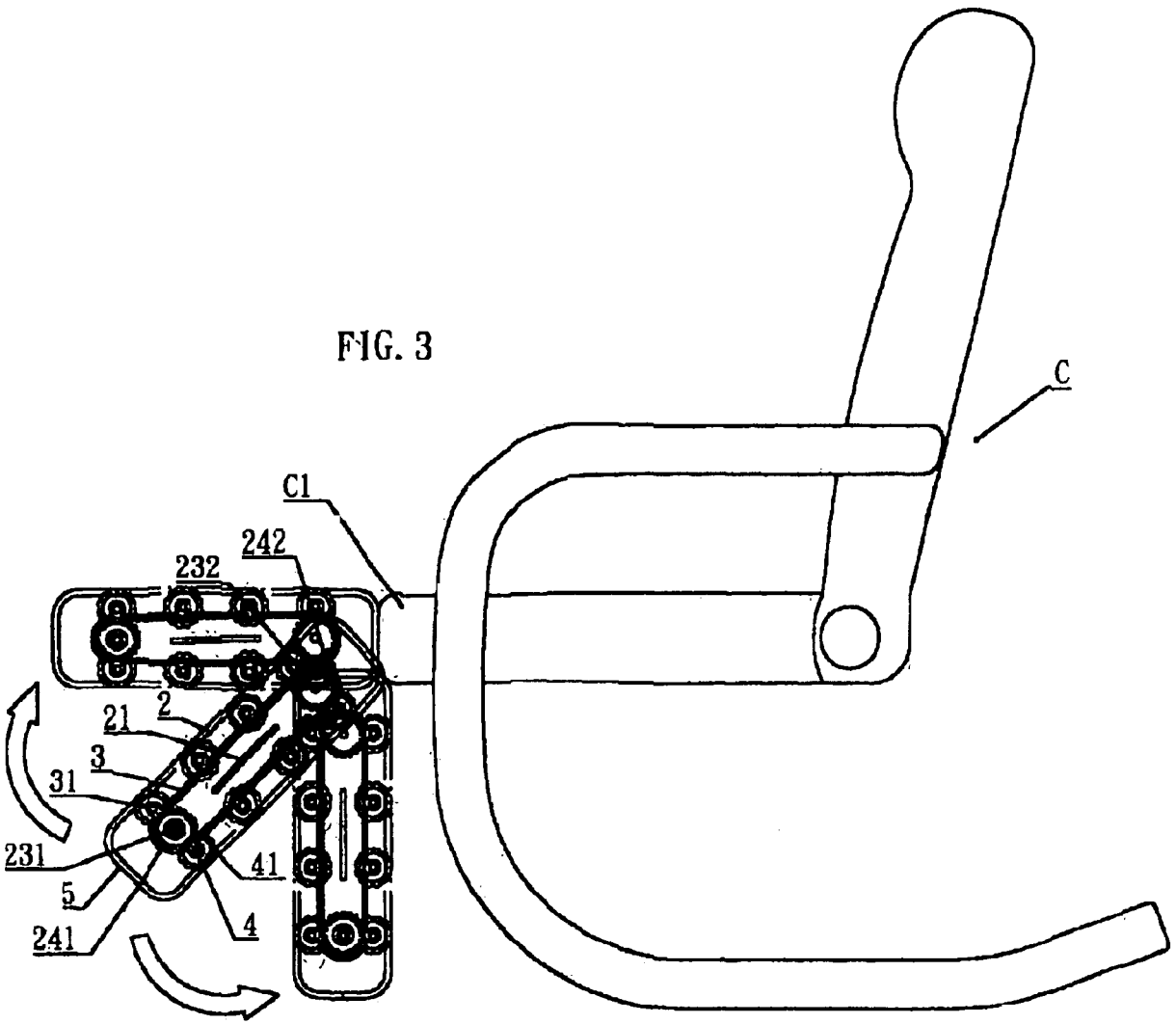
FIG. 3 is a plane view of the present invention.

Referring to FIGS. 1, 2 and 3, the present invention is a circled massage device with multi-axis rollers which can be used independently or used with an orientation adjuster (not shown) to be assembled to a chair, a middle or lower section of a pad CI (referring to FIG. 3) for massaging the back, leg, foot, palm, etc. of the user repeatedly. The roller of the present invention has the following components.

A casing 2 has a top which has a hollow open section 2A. A plurality of transversal plates 22 are placed between two inner lateral sides of the casing 2. Two support plates 21 are extended from the other two inner lateral sides of the casing to resist against two outer transversal plates. A driving shaft 231 and a driven shaft 232 are transversally across the transversal plates 22. Two ends of the driving shaft 231 are installed with two respective driving gears 241 and two ends of the driven shaft 232 are installed with two respective driven gears 242. The driving shaft 231 is driven by a motor M installed between two transversal plates 22. The motor is installed on a transversal support plate 25 across two transversal plates 22.

A pair of circled belts 3 are engaged with the driving gears 241 and driven gears 242 at the inner sides thereof. Then the structure is installed in the inner side of the casing 2. A periphery of the belt is installed with a plurality of sleeves 31.

A plurality of roller shafts 4 is installed, and the number thereof is equal to that of the sleeves on each belt 3. The ends of the roller shafts are inserted into the sleeves 31 of the belts 3 so that the belt can drive the roller shafts 4. A plurality of rollers 41 are engaged with the roller shaft 4. The top of each roller 41 can protrude from the top open section 2A of the casing 2 for massaging the portion of the user. The rollers are not placed upon the transversal plates 22 so that the roller shafts 4 can be placed upon the transversal plates 22 to be supported thereon.

By above structure, the belt can drive the rollers to rotate and thus the user is massaged by the rollers.

The casing 2 can be enclosed by a wear-tolerate cloth or cover 5 (referring to FIG. 2). Thereby, the portion to be massaged indirectly contacts with the rollers 41 through the cover so that the user may feel easy.

Figure 4:
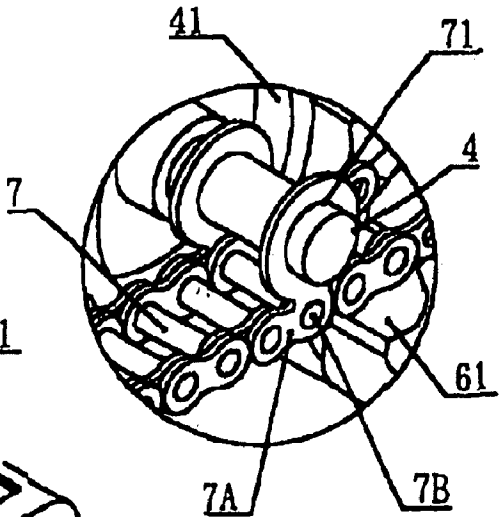
FIG. 4 is a schematic perspective view of the chain in the second embodiment of the present invention.
Figure 4:
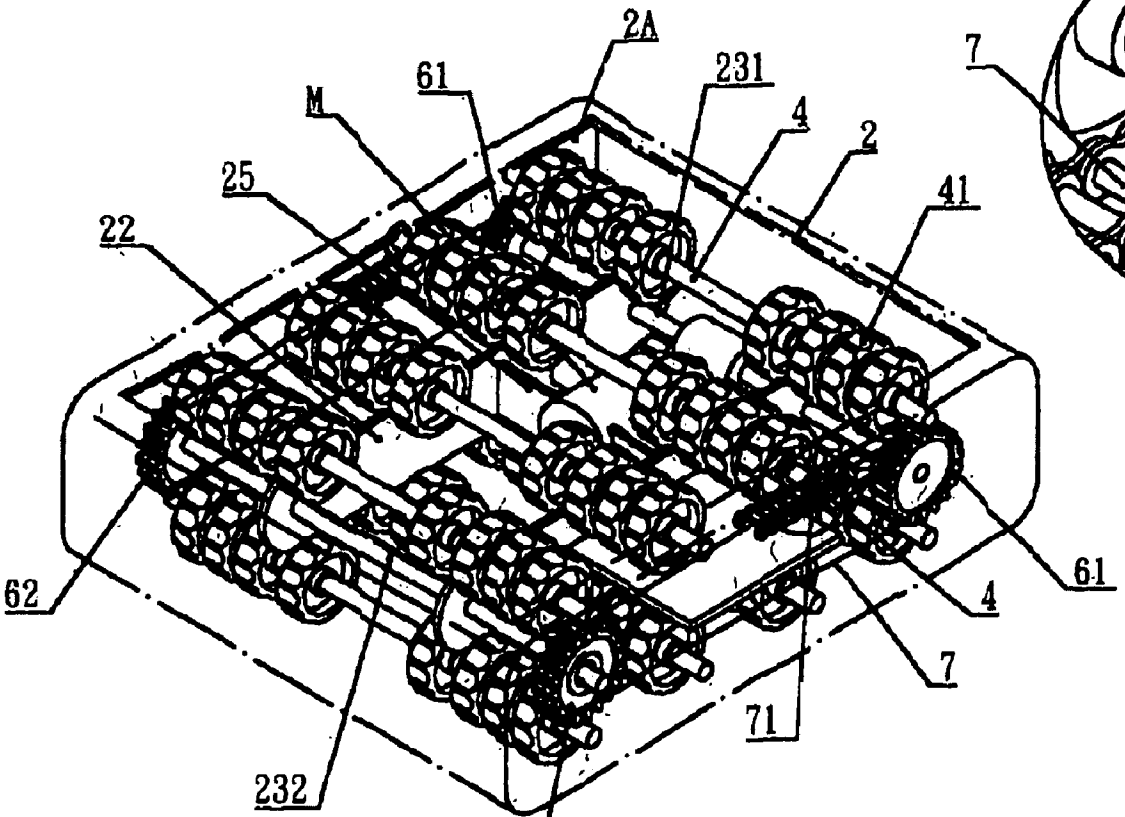

Referring to FIG. 4, the driving gears 241 and driven gears 242 are used with the belt 3 having the plurality of sleeves 31, while these can be replaced by a chain 7 with driving chain wheels 61 and driven chain wheels 62. The sleeves 71 around the chain 7 are extended from two chain pieces 7A so as to achieve the same effect as above embodiment.

Figure 5:
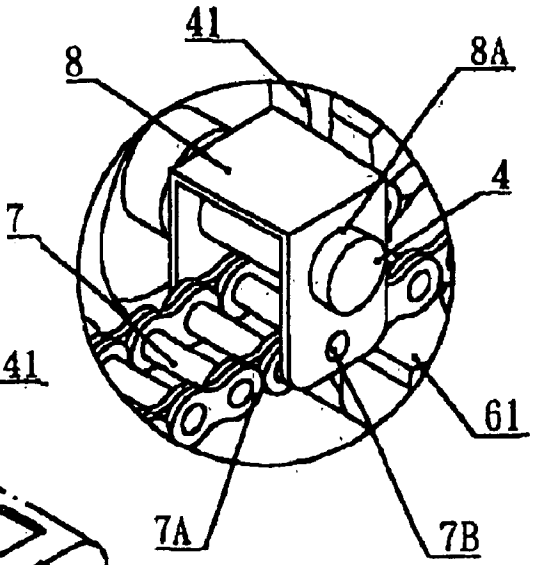
FIG. 5 is an assembled schematic view of the second embodiment of FIG. 4.
Figure 5:
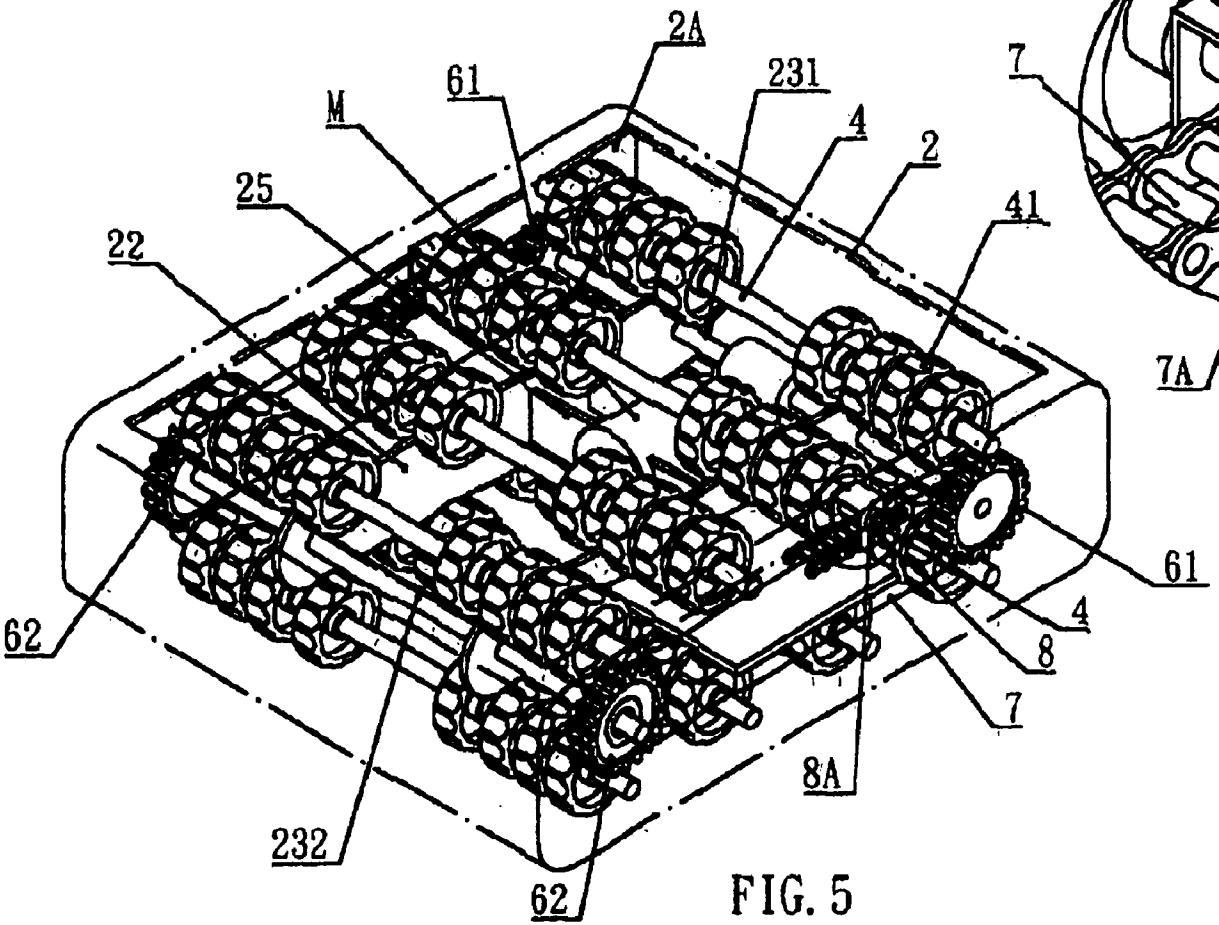

Referring to FIG. 5, in this embodiment, the chain 7 has sleeves 81 which have a U-like shape. Two sides of the sleeves have openings 8A for being inserted by roller shafts 41. The U shape sleeves are engaged to the chain 7 through a stud 7B.

Figure 6:
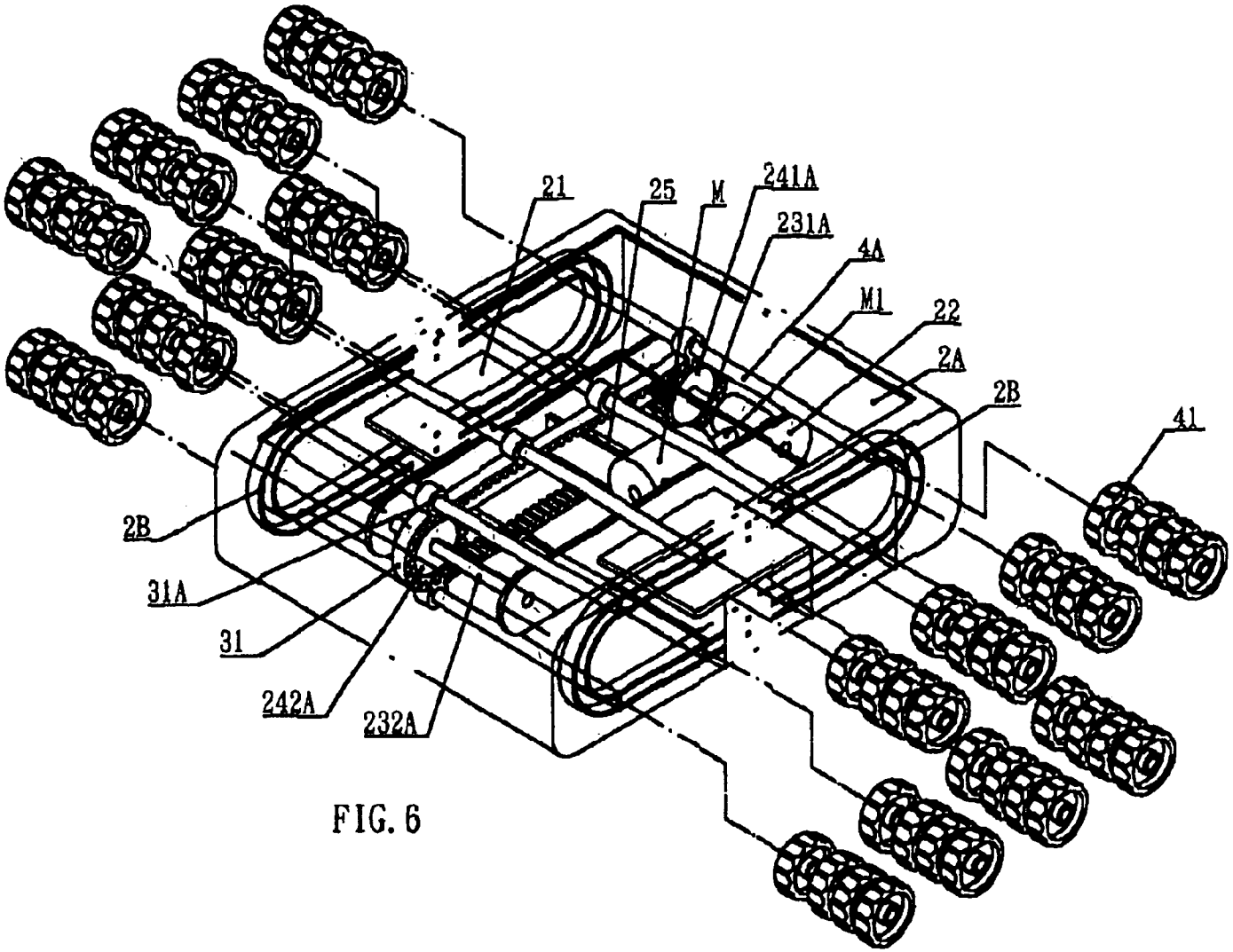
FIG. 6 is an assembled schematic view of another embodiment of the present invention.

Referring to FIG. 6, in another embodiment, a driving shaft 231A and a driven shaft 232A are installed across the transversal plates 22. The middle sections of each driving shaft 231A and each driven shaft 232A are installed with one driving gear 241A and one driven gear 242A. A belt 3A (or chain 7) is engaged with the driving gear 241 and driven gear 242 at the interior of the belt 3A (or chain 7). A plurality of roller shafts 4A are inserted through sleeves 31A (or sleeves 71, or 81). Two ends of the roller shafts 4A are inserted into slots 2B at two sides of the casing 2 so that the roller shafts 4A can rotate therein.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A massage device with rollers distributed in a plurality of roller shafts comprising:

a casing having a top which has a hollow open section and the casing being formed by four lateral sides;

a plurality of transversal plates being placed between two inner opposite lateral sides of the casing; two support plates being extended from the other two inner lateral sides of the casing to support two outer transversal plates of the plurality of transversal plates;

a driving shaft and a driven shaft being transversally across the transversal plates: two ends of the driving shaft being installed with two respective driving gears and two ends of the driven shaft being installed with two respective driven gears; the driving shaft being driven by a motor installed between two transversal plates; and the motor being installed on a transversal support elate across two transversal plates;

a pair of circled belts engaged with the driving gears and driven gears at an inner sides thereof; each belt being installed in an inner side of the casing; a periphery of each belt being installed with a plurality of sleeves;

a plurality of roller shafts a number of which is equal to that of the sleeves on each belt; two ends of the roller shafts being inserted into the sleeves of the belts so that the belts drive the roller shafts; a plurality of rollers being engaged with the roller shaft; a top of each roller protruding from a top open section of the casing for massage; the rollers being not placed upon the transversal plates so that the roller shafts being placed upon the transversal plates to be supported thereon;

wherein by above structure, the belt drives the rollers to rotate and thus the user is massaged by the rollers.

2. The massage device with rollers distributed in a plurality of roller shafts as claimed in claim 1, wherein the casing is enclosed by a wear-tolerate cloth or cover; thereby, the portion to be massaged indirectly contacts with the rollers through the cover so that the user may feel comfortable.

* * * * *